United States Patent [19]

Mallonen et al.

[11] Patent Number: 4,633,210

[45] Date of Patent: Dec. 30, 1986

[54] THERMAL OVERLOAD RELAY WITH IMPROVED RESPONSE

[75] Inventors: Edward A. Mallonen, New Berlin; William A. Autio, Menomonee Falls, both of Wis.

[73] Assignee: Eaton Corporation, Cleveland, Ohio

[21] Appl. No.: 778,639

[22] Filed: Nov. 4, 1985

[51] Int. Cl.[4] ..... H01H 61/00; H01H 71/22

[52] U.S. Cl. ..... 337/101; 337/99

[58] Field of Search ..... 337/100, 102, 70, 101, 337/99

[56] References Cited

U.S. PATENT DOCUMENTS

| | | | |
|---|---|---|---|
| 2,109,169 | 2/1938 | Field | 337/44 |
| 2,338,474 | 1/1944 | Wilson | 337/96 |
| 3,078,661 | 2/1963 | Mason et al. | 219/20 |
| 3,124,957 | 3/1964 | Bungo | 73/362.4 |
| 3,243,553 | 3/1966 | Doyle | 337/96 |
| 3,611,236 | 10/1971 | Randolph | 337/101 |
| 3,718,162 | 2/1973 | Dafler | 337/94 |

FOREIGN PATENT DOCUMENTS

| | | | |
|---|---|---|---|
| 1435026 | 10/1968 | Fed. Rep. of Germany | 337/99 |

*Primary Examiner*—Harold Broome

*Attorney, Agent, or Firm*—C. H. Grace; W. A. Autio

[57] ABSTRACT

Improved response in an ambient temperature compensated thermal overload relay is obtained by providing a bimetal element (2) wherein the main bimetal section (4) is coupled through a reversed compensating bimetal section (6) to a heat sink mounting base (8) either directly or through a heat transfer control member (18) and placing the heater (10) that is energized by the overload current only adjacent the main bimetal section (4). With this arrangement, the main bimetal section (4) bends in the switch tripping direction and the compensating bimetal section (6) bends in the subtractive direction in response to temperature change therein to reduce the net deflection for ambient temperature compensation under normal operating conditions and gradual small overload conditions. The heater (10) provides a temperature differential between the main (4) and reverse (6) bimetal sections although the reverse bimetal section (6) is subject to some conduction temperature rise above ambient temperature due to controlled thermal conduction from the main bimetal section (4) thereto and therethrough to the heat sink (8). But under fast high overload conditions, the reverse bimetal section (6) has insufficient time to incur a substantial amount of the conduction temperature rise to afford quicker tripping of the switch (16) for improved response. The ratio of the lengths of the main and reverse bimetal sections (4,6) is set or selected for the desired compensation.

8 Claims, 4 Drawing Figures

THERMAL OVERLOAD RELAY WITH IMPROVED RESPONSE

BACKGROUND OF THE INVENTION

Thermal responsive devices with ambient temperature compensation have been known heretofore. For example, O. S. Field Pat. No. 2,109,169, dated Feb. 22, 1938, shows a thermal operated circuit controlling device having a bimetal strip mounted at its lower end in a glass tube and having a compensating bimetal strip welded to its upper end with the two strips oriented to deflect in opposite directions in response to temperature change thereby to provide ambient temperature compensation. The lower bimetal strip is heated by a coil of resistance wire. Varying the pressure of gas in the tube causes change in the rate of dissipation of heat, the gas being the heat sink, so as to increase or decrease the time required to operate the contacts for a given heating current. While such prior thermal responsive devices have been useful for their intended purposes, this invention relates to improvements thereover.

SUMMARY OF THE INVENTION

An object of the invention is to provide a thermal overload relay with improved response.

A more specific object of the invention is to provide an improved thermal overload relay with means for providing ambient temperature compensation under normal operating conditions and gradual small overload conditions but providing less compensation and thus faster response for fast rise abnormally high overload conditions.

Another specific object of the invention is to provide a thermal overload relay with improved means for providing an improved response time for abnormally high overload conditions while providing normal response time under normal operating conditions and gradual small overload conditions.

Another specific object of the invention is to provide a thermal overload relay with improved ambient temperature compensating means that relies for its operation not only on ambient temperature but also on a portion of the current generated heat conduction thereto under normal operating conditions and gradual small overload conditions but which does not receive such current generated heat conduction thereto when the overload current rises faster to an abnormally high value thereby to cause improved response time for abnormally high overloads.

Another specific object of the invention is to provide a thermal overload relay of the aforementioned type with means for controlling the rate of current generated heat conduction to the ambient temperature compensating means thereby to control the response time under normal operating conditions and gradual small overload conditions.

Another specific object of the invention is to provide a thermal overload relay of the aforementioned type with improved means for controlling the thermal coupling between the thermal overload means and the thermal ambient temperature compensating means.

Other objects and advantages of the invention will hereinafter appear.

These and other objects of the invention are attained by providing a thermal overload relay with improved response for monitoring an electrical system current comprising a heat sink mounting member, a thermal member supported at one end in cantilever manner on said mounting member so as to have a supported end and a free end, said thermal member comprising a main bimetal section at its free end and a reverse bimetal section at its supported end arranged so that the main bimetal section bends in the tripping direction and said reverse bimetal section bends in the subtractive direction in response to temperature change therein to reduce the net deflection for ambient temperature compensation under normal operating conditions and gradual small overload conditions, switch means effective when tripped for protecting said electrical system from overload current, a heater in proximity to said main bimetal section responsive to said system current for heating said main bimetal section so as to provide a temperature differential between said main and reverse bimetal sections although said reverse bimetal section is subject to some conduction temperature rise above ambient temperature due to thermal conduction from said main bimetal section thereinto and therethrough to said heat sink mounting member, and means coupling the free end of said main bimetal section to said switch means so that when said system current exceeds a predetermined value on said gradual small overload conditions said net deflection will be of sufficient magnitude to trip said switch means and when said system current rises faster to an abnormally high value so as to exceed said predetermined value by a large amount said reverse bimetal section has insufficient time to incur a substantial amount of said conduction temperature rise and consequent subtractive deflection thereby providing a net deflection greater than said gradual overload net deflection to cause a quicker trip of said switch means to provide an improved response time for abnormally high overloads.

DESCRIPTION OF THE PREFERRED EMBODIMENT

Figure 1:
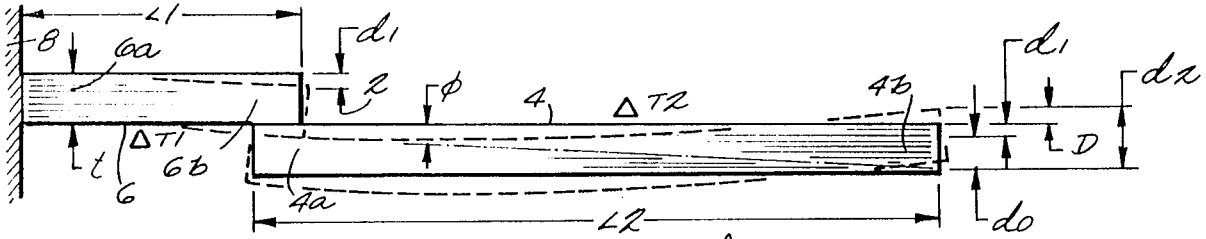
FIG. 1 is a side view of a bimetal thermal element constructed in accordance with the invention and showing deformation or deflection thereof under ambient temperature and overload conditions.

Referring to FIG. 1, there is shown a thermal member such as a bimetal member or element 2 comprising a main bimetal section 4 at its free end and a reverse or compensating bimetal section 6 at its supported end arranged so that the main bimetal section bends in the tripping direction and the reverse bimetal section bends in the subtractive direction in response to temperature change therein to reduce the net deflection of the bimetal element for ambient temperature compensation. As shown in FIG. 1, supported end **6*a*** of compensating bimetal section 6 is rigidly secured to a heat sink support 8 and is rigidly connected at its other end 6*b* to supported end 4*a* of main bimetal section 4 so that the free end 4*b* of main bimetal section 4 extends toward the right as a cantilever beam. The two bimetal sections may be secured to one another at their adjacent ends 4*a* and 6*b* by welding, riveting or the like.

These bimetal sections may be made in known manner of any suitable metallic materials having different coefficients of expansion with the materials being secured to one another along their lengths and arranged in reversed relation so that free end 4*b* of main bimetal section 4 bends upwardly when this main bimetal section is heated and end 6*b* of reverse bimetal section 6 bends downwardly when it is heated under ambient temperature rise or under heat transfer thereinto from main bimetal section 4.

As shown in FIG. 1, compensating bimetal section 6 has a length L1 and a thickness t and the change in temperature therein is indicated adjacent thereto by ΔT1. This change in temperature will cause the right end 6*b* of compensating bimetal section 6 to deflect downwardly a distance d1. In a similar manner, main bimetal section 4 has a length L2 and may be assumed to have a similar thickness t. The change in temperature in this main bimetal section 4 is indicated by ΔT2 adjacent thereto.

The unheated positions of the two bimetal sections 4 and 6 are shown in solid lines in FIG. 1. When reverse bimetal section 6 is heated under ambient temperature rise of an amount ΔT1, its right end 6*b* will deflect downwardly a distance d1. Since the two bimetal sections are rigidly secured to one another at their adjacent ends 4*a* and 6*b*, this deflection d1 will cause main bimetal section 4 to rotate clockwise an angle $\phi$ and to move downwardly a distance d1. When main bimetal section 4 is heated due to overload current in the system in which it is used, free end 4*b* thereof will deflect upwardly a distance d2. However, this entire deflection d2 is not available for actuating a protective switch because certain quantities will be subtracted therefrom as indicated in FIG. 1. These quantities include the distance do which is the distance that free end 4*b* of the main bimetal section moves downwardly or clockwise as a result of clockwise rotation of main bimetal section 4 by reverse bimetal section 6. These quantities also include the distance d1 which is the distance that main bimetal section 4 is bodily lowered by the deflection of reverse bimetal section 6 as indicated by broken lines in FIG. 1. Consequently, the resultant upward deflection D is available for actuation of a protective switch in response to overload current heating of main bimetal section 4. The relationships are as follows:

$$\text{Angle } \phi = \frac{C(\Delta T1)L1}{t}$$

where C is a constant, ΔT1 is the change in temperature in compensating bimetal section 6, L1 is the length of bimetal section 6 and t is the thickness thereof as indicated in FIG. 1.

$$\text{Deflection } d1 = \frac{K(\Delta T1)L1^2}{t}$$

where K is a constant and ΔT1, L1 and t are as described above.

$$\text{Deflection } d2 = \frac{K'(\Delta T2)L2^2}{t}$$

where K′ is a constant, Δ T2 is the change in temperature in main bimetal section 4, L2 is the length and t is the thickness of bimetal section 4.

$$\text{Rotational deflection do} = L2 \tan \phi$$

where L2 is the length of main bimetal section 4 and tan $\phi$ is the tangent of the angle $\phi$ by which main bimetal section 4 is rotated clockwise by bending of compensating bimetal section 6; it being that the deflection is small compared to the length.

$$D = d2 - do - d1$$

That is, the resultant deflection D is the total bending of main bimetal section d2 minus its rotational deflection and its bodily downward movement due to bending of compensating bimetal section 6.

Figure 2:
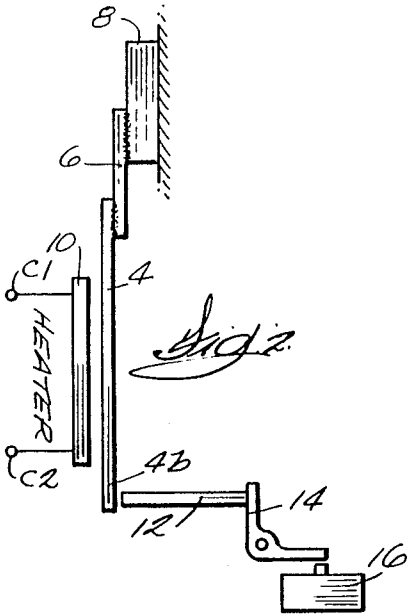
FIG. 2 is a schematic illustration of a thermal overload relay using the bimetal thermal element of FIG. 1 and showing the relative location of the heater and the switch that is tripped under overload conditions.

The function of the bimetal element shown in FIG. 1 to provide improved response time will now be described. This, improvement in response time is accomplished by thermally close-coupling the ambient temperature compensating bimetal section 6 to the main bimetal section 4. This close-coupling is accomplished by reversing the cantilevered thermostatic element 2 at its anchored end 6. The reversed section 6 is proportioned to take advantage of the leverage gained from the anchor end to the free end of the cantilevered beam. This proportion in length is arranged to provide adequate element deflection to open the relay contacts when there exists a differential temperature between the two sections. However, under ambient temperature variations where the two sections have equal temperatures, the net deflection is reduced so as to provide an ambient compensation effect. Under normal operating conditions, wherein the main bimetal section 4 is heated by the adjacent heater 10, a temperature differential exists due to the thermal conduction to the element anchoring support. Under this condition, the reversed section 6 has a temperature rise above ambient which in turn provides a subtractive or negative deflection in the sense of opening the contacts. The main bimetal section 4 experiences a higher temperature rise such that a net deflection D results which tends toward opening the relays contacts. As shown in FIG. 2, heater 10 is heated by current flow through conductors C1 and C2 which are appropriately connected to the electric motor to receive a heating current proportional to the overload condition. When free end 4*b* of main bimetal section 4 deflects toward the right as shown in FIG. 2, it operates through link 12 and a pivotal member 14 to actuate switch 16 thereby to interrupt power to the motor. When the motor current in the heater exceeds the prescribed value, this net deflection will be of sufficient magnitude to trip open the power contacts. But under abnormal currents, the reversed section 6 has insufficient time to heat up due to its heat sinking and thus cannot provide the full subtractive deflection. This creates a net deflection which is greater than the steady state temperature deflection for any given current. This, in effect, causes a premature or quicker trip condition which is an improved response time designed to meet the protection requirements of the high efficiency motors. It is necessary to shorten the response time of the overload protective device when it is applied to high efficiency motors with reduced thermal capacity. This invention provides an improved response time designed to protect these types of motors while maintaining the advantage of flexibility of interchangeable heater elements when used in overload relays such as shown in K. A. Forsell and E. A. Mallonen U.S. Pat. No. 4,528,539, dated July 9, 1985. While a single bimetal element 2 is shown in FIGS. 1 and 2, it will be apparent that the usual application would be in a three phase motor control system using three like bimetal elements in a thermal overload relay such as shown in the aforementioned patent.

Figure 3:
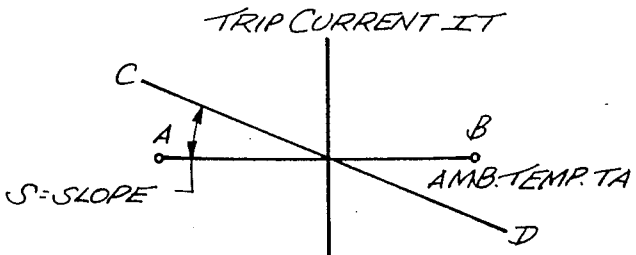
FIG. 3 is a graph showing the variation in the ambient temperature compensation obtainable by preselecting the lengths or the ratio of the lengths of the main and reverse bimetal sections of the thermal element of FIG. 1.

The lengths of the compensating and main bimetal sections or the ratio of their lengths may be predetermined and set to obtain the desired improved response. As an example, the total length of the bimetal element in FIG. 1 or L1 plus L2 may be 1.65 inches or L1 may be 0.38 inch and L2 may be 1.27 inch to provide an L1/L2 ratio of roughly 0.3. It will readily be apparent that these lengths or relative lengths are not fixed and may be adjusted or selected to provide the desired response. FIG. 3 shows in graph form a trip current versus ambient temperature characteristic. The line A-B in FIG. 3 shows flat compensation, that is, at different ambient temperatures, the overload current must always rise the same amount to trip the switch. However, the line C-D having a slope S shows a typical desired compensation that can be obtained by using or adjusting the L1/L2 ratio. With the under compensation line C-D characteristic, an increase in ambient temperature requires a proportional decrease in overload current to reach the trip point.

Figure 4:
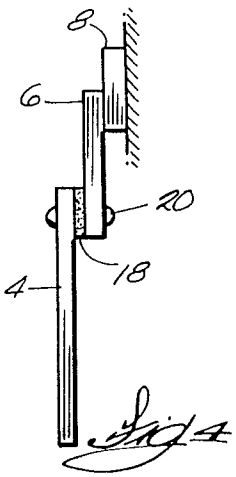
FIG. 4 is a modification of the bimetal thermal element of FIG. 1 showing the interposition of a heat conduction control member between the main and reverse bimetal sections.

In the modification shown in FIG. 4, reference characters like those in FIGS. 1 and 2 have been used for like elements. In this modification, compensating bimetal section 6 is rigidly secured in heat transfer relation to heat sink 8 as in FIGS. 1 and 2. However, main bimetal section 4 is attached to compensating bimetal section 6 by the interposition of a heat conduction control or a heat transfer control member 18 which is clamped between the adjacent ends of bimetal sections 4 and 6 by a rivet 20. While a rivet 20 is shown for illustrative purposes, it will be apparent that other means may be used for securing these parts together. As shown in FIG. 2, heater 10 is placed adjacent main bimetal section 4 and therefore is remote from compensating bimetal section 6 so that it heats bimetal section 4 primarily. However, when the two bimetal sections are welded contiguously together as shown in Fig. 2, there will be a certain amount of heat flow from main bimetal section 4 to compensating bimetal section 6 due to the heating of bimetal section 4 by heater 10 under normal operating conditions and gradual small overload conditions. But under high overload conditions when the system current rises faster to an abnormally high value, there is insufficient time for such heat flow or transfer from bimetal section 4 to bimetal section 6 and therethrough to heat sink 8 to take place thereby providing the improved response hereinbefore described. As shown in the modification in FIG. 4, it is desirable to be able to control the rate of heat conduction or flow from main bimetal section 4 to compensating bimetal section 6 and for this reason a heat conduction control member 18 is interposed therebetween. This heat transfer control member 18 may be a sheet of mica or a fiberglass mat or pad known as a "glassmat" or the like by which the rate of heat transfer between the bimetal sections can be limited or controlled. It will readily be apparent that the use of such a heat transfer control member of the proper area and thickness between the bimetal sections can be used to control the amount of improved response under high overload conditions and can also be used to control the temperature differential between the main and reverse bimetal sections under normal operating conditions and gradual small overload conditions, permitting an optimum L1/L2 compensation ratio for the bimetal sections.

While the apparatus hereinbefore described is effectively adapted to fulfill the objects stated, it is to be understood that the invention is not intended to be confined to the particular preferred embodiment of thermal overload relay with improved response disclosed, inasmuch as it is susceptible of various modifications without departing from the scope of the appended claims.

We claim:

1. A thermal overload relay with improved response for monitoring an electrical system current comprising:

a heat sink mounting member;

a thermal member supported at one end in cantilever manner on said heat sink mounting member so as to have a supported end and a free end;

said thermal member comprising a main bimetal section at its free end and a reverse bimetal section at its supported end coupled in heat transfer relationship with respect to one another and said heat sink mounting member and arranged so that said main bimetal section bends in the tripping direction and said reverse bimetal section bends in the substractive direction in response to temperature change therein to reduce the net deflection for ambient temperature compensation under normal operating conditions and gradual small overload conditions;

switch means effective when tripped for protecting said electrical system from overload current;

a heater in proximity to said main bimetal section responsive to said system current for heating said main bimetal section so as to provide a temperature differential between said main and reverse bimetal sections although said reverse bimetal section is subject to some conduction temperature rise above ambient temperature due to thermal conduction from said main bimetal section thereinto and therethrough to said heat sink mounting member;

and means coupling the free end of said main bimetal section to said switch means so that when said system current exceeds a predetermined value on said gradual small overload conditions said net deflection will be of sufficient magnitude to trip said switch means and when said system current rises faster to an abnormally high value so as to exceed said predetermined value by a large amount said reverse bimetal section has insufficient time to incur a substantial amount of said conduction temperature rise and consequent subtractive deflection due to said heat sink thereby providing a net deflection greater than said gradual overload net deflection to cause a quicker trip of said switch means to provide an improved response time for abnormally high overloads.

2. The thermal overload relay with improved response as claimed in claim 1, wherein:

said main and reverse bimetal sections are bimetal strips of different lengths;

and said thermal member also comprises means for rigidly connecting said main and reverse bimetal strips to one another at their adjacent ends.

3. The thermal overload relay with improved response as claimed in claim 2, wherein:

said means for rigidly connecting said main and reverse bimetal strips to one another comprises means for securing their adjacent end portions together in overlapped relation.

4. The thermal overload relay with improved response as claimed in claim 2, wherein:

said reverse bimetal strip is shorter than said main bimetal strip.

5. The thermal overload relay with improved response as claimed in claim 2, wherein:

said means for rigidly connecting said main and reverse bimetal strips to one another at their adjacent ends comprises means for connecting the same in predetermined heat conducting relation.

6. The thermal overload relay with improved response as claimed in claim 5, wherein:

said means for connecting the same in predetermined heat conducting relation comprises means interposing a heat conduction control member between said adjacent ends of said bimetal strips.

7. The thermal overload relay with improved response as claimed in claim 6, wherein:

said heat conduction control member is a sheet of mica between said adjacent ends of said bimetal strips that limits the rate of heat flow from said main bimetal section to said reverse bimetal section.

8. The thermal overload relay with improved response as claimed in claim 6, wherein:

said heat conduction control member is a fiberglass mat such as a glassmat between said adjacent ends of said bimetal strips that limits the rate of heat flow from said main bimetal section to said reverse bimetal section.

* * * * *